US009609945B2

(12) United States Patent
Krusin et al.

(10) Patent No.: US 9,609,945 B2
(45) Date of Patent: Apr. 4, 2017

(54) ARTICLE OF FURNITURE HAVING A LATCH MECHANISM

(71) Applicant: Knoll, Inc., East Greenville, PA (US)

(72) Inventors: Marc Krusin, London (GB); Pavel Ruzicka, Pennsburg, PA (US); Michael Harper, Bethlehem, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 15/096,387

(22) Filed: Apr. 12, 2016

(65) Prior Publication Data

US 2016/0309888 A1 Oct. 27, 2016

Related U.S. Application Data

(60) Provisional application No. 62/151,095, filed on Apr. 22, 2015.

(51) Int. Cl.
*A47B 3/00* (2006.01)
*A47B 3/08* (2006.01)
(Continued)

(52) U.S. Cl.
CPC ..... *A47B 3/0809* (2013.01); *A47B 3/08* (2013.01); *A47B 3/0818* (2013.01); *A47C 4/00* (2013.01);
(Continued)

(58) Field of Classification Search
CPC ..... A47B 7/02; A47B 3/0809; A47B 3/0818; A47B 3/00; A47B 3/08; A47B 3/0803;
(Continued)

(56) References Cited

U.S. PATENT DOCUMENTS 2,533,173 A * 12/1950 Mitchell ..... A47B 3/0818 108/130
4,986,195 A 1/1991 Diffrient
(Continued)

FOREIGN PATENT DOCUMENTS

DE 102008052538 * 4/2010

OTHER PUBLICATIONS

International Search Report and Written Opinion of the International Searching Authority PCT/US2012/027183 dated Jun. 28, 2016.

(Continued)

*Primary Examiner* — Janet M Wilkens
(74) *Attorney, Agent, or Firm* — Buchanan Ingersoll & Rooney PC

(57) ABSTRACT

An article of furniture can include a latch mechanism. The latch mechanism can include an actuation mechanism having a housing that is moveable relative to a guide member from a first position to a second position, at least one detent mechanism comprising a first detent mechanism having a first detent member that is moveable from a first position to a second position, and an articulation mechanism positioned between the actuation mechanism and the first detent mechanism. The articulation mechanism can connect the first detent mechanism to the housing such that motion of the housing from the first position of the housing to the second position of the housing causes the first detent member to move from the first position of the first detent member to the second position of the first detent member.

16 Claims, 11 Drawing Sheets

(51) Int. Cl.

| | |
|---|---|
| ***E05C 9/04*** | (2006.01) |
| ***A47C 4/00*** | (2006.01) |
| ***A47C 7/00*** | (2006.01) |
| *A47B 7/02* | (2006.01) |

(52) U.S. Cl.
CPC ..... *A47C 7/00* (2013.01); *E05C 9/043* (2013.01); *A47B 7/02* (2013.01); *A47B 2003/0806* (2013.01); *A47B 2200/0036* (2013.01)

(58) Field of Classification Search
CPC . A47B 3/0815; A47B 2003/0806; A47C 4/00; A47C 7/00
USPC ..... 248/188.1, 188.2, 166, 439; 108/7, 115, 108/91, 6
See application file for complete search history.

(56) References Cited

U.S. PATENT DOCUMENTS

| | | | | |
|---|---|---|---|---|
| 6,164,217 | A | 12/2000 | Prendergast | |
| 6,637,352 | B1 | 10/2003 | Thode et al. | |
| 6,845,723 | B2 | 1/2005 | Kottman et al. | |
| 7,066,098 | B2 | 6/2006 | Blasen et al. | |
| 7,614,351 | B2 | 11/2009 | Piretti | |
| 7,712,422 | B2 | 5/2010 | Bue | |
| 7,845,290 | B2 | 12/2010 | Piretti | |
| 7,878,128 | B2 | 2/2011 | Watson et al. | |
| 8,051,784 | B2 | 11/2011 | Hsu | |
| 8,069,795 | B1 | 12/2011 | Williams et al. | |
| 8,091,488 | B2 | 1/2012 | Chirea et al. | |
| 8,171,863 | B2 | 5/2012 | Nyenhuis et al. | |
| 8,272,336 | B2 * | 9/2012 | Rutz | A47B 3/08 108/115 |
| 8,297,208 | B2 | 10/2012 | Hoffman | |
| 8,359,983 | B2 | 1/2013 | Williamson et al. | |
| 3,413,593 | A1 | 4/2013 | Korb | |
| 8,578,864 | B2 | 11/2013 | Nyenhuis et al. | |
| 8,869,715 | B2 | 10/2014 | Hoffman | |
| 9,265,340 | B2 | 2/2016 | Krusin et al. | |
| 2007/0137534 | A1 * | 6/2007 | Dhanoa | A47B 3/0812 108/115 |
| 2007/0209559 | A1 | 9/2007 | Mockel | |
| 2008/0178778 | A1 * | 7/2008 | Koning | A47B 3/0818 108/132 |
| 2008/0196635 | A1 | 8/2008 | Piretti | |
| 2010/0258042 | A1 * | 10/2010 | Rutz | A47B 3/0818 108/115 |
| 2010/0300239 | A1 | 12/2010 | Rutz | |
| 2011/0139042 | A1 | 6/2011 | Korb | |

OTHER PUBLICATIONS

Written Opinion of the International Searching Authority PCT/US2012/027183 dated Jun. 28, 2016.

* cited by examiner

ARTICLE OF FURNITURE HAVING A LATCH MECHANISM

CROSS-REFERENCE TO RELATED APPLICATIONS

The present application claims priority to U.S. Provisional Patent Application No. 62/151,095, which was filed on Apr. 22, 2015.

FIELD OF INVENTION

The innovation relates to articles of furniture, such as tables, desks, or other types of furniture.

BACKGROUND OF THE INVENTION

Tables and other articles of furniture are often configured to have a number of legs that support a surface. For instance, tables may have legs, a stand or other type of base that supports a tabletop and a chair may have a pedestal, legs, or other type of base that supports a seat and/or a backrest. Examples of articles of furniture may be appreciated from U.S. Pat. Nos. 6,164,217, 6,637,352, 6,845,723, 7,066,098, 7,614,351, 7,712,422, 7,845,290, 7,878,128, 8,051,784, 8,069,795, 8,091,488, 8,171,863, 8,297,208, 8,359,983, 8,413,593, 8,578,864, and 8,869,715 and U.S. Pat. App. Pub. No. 2008/0196635. U.S. Pat. No. 9,265,340 also discloses an example of an article of furniture and mechanisms that may be used in articles of furniture.

Some types of tables, chairs and other kinds of furniture may be nested, or stacked when stored to preserve space. For instance, chairs may be configured to be stacked on top of each other. As another example, tables may be configured to be stacked on top of each other or nested beside other tables.

But, keeping the article of furniture in a configuration for nesting and/or stacking can often be problematic. For instance, some articles of furniture may be designed so that they are easily adjusted from a stacked or nested position to a use position. But, such ease of adjustability may also result in the article of furniture adjusting positions when a user does not desire this change in position to occur. Further, such an ease of adjustability can also contribute to users becoming injured or hurt when the position of the article is adjusted.

SUMMARY OF THE INVENTION

An article of furniture, a latch mechanism for an article of furniture, and a method of using such an article of furniture and/or such a latch mechanism are provided. In some embodiments, an article of furniture may include a latch mechanism that is actuatable to unlock a position of a structure so that the structure is moveable from a use position to a stacked or nested position. In some embodiments of the method, use of an embodiment of such a latch mechanism may occur prior to the structure being moved from a use position to a stacked or nested position and/or vice versa.

Embodiments of a latch mechanism for an article of furniture can include an actuation mechanism having a housing attached to a guide member. The housing can be moveable relative to the guide member from a first position to a second position. The latch mechanism can also include at least one detent mechanism comprising a first detent mechanism having a first detent member that is moveable from a first position to a second position. An articulation mechanism can be positioned between the actuation mechanism and the first detent mechanism. The articulation mechanism can connect the first detent mechanism to the housing such that motion of the housing from the first position of the housing to the second position of the housing causes the first detent member to move from the first position of the first detent member to the second position of the first detent member.

In some embodiments, the at least one detent mechanism can also comprise a second detent mechanism having a second detent member that is moveable from a first position to a second position. The second detent member can be connected to the housing via the articulation mechanism such that motion of the housing from the first position of the housing to the second position of the housing causes the second detent member to move from the first position of the second detent member to the second position of the second detent member at the same time the first detent member moves from the first position of the first detent member to the second position of the first detent member.

The latch mechanism can also include a first elongated member, a second elongated member, and a third elongated member. The first elongated member can extend from the articulation mechanism to the first detent member to connect the first elongated member to the articulation mechanism. The second elongated member can extend from the articulation mechanism to the second detent member to connect the second elongated member to the articulation mechanism. The third elongated member can extend from the housing of the actuation mechanism to the articulation mechanism to connect the articulation mechanism to the housing.

In some embodiments, the articulation mechanism can include a first rotatable member and a second rotatable member positioned in a housing of the articulation mechanism. The first and second rotatable members can be attached to the third elongated member such that movement of the housing of the actuation mechanism from the first position to the second position of the housing of the actuation mechanism causes the third elongated member to move such that the first and second rotatable members rotate. The articulation mechanism can also include a connector having a shaft that passes through the first rotatable member, the second rotatable member, and an end portion of the third elongated member to connect the third elongated member to the first and second rotatable members.

The guide mechanism can be configured to be affixed to a structure of an article of furniture. For instance, the guide member can be connectable to the housing of the actuation mechanism such that the housing is moveable relative to the guide member from the first position of the housing of the actuation mechanism to the second position of the housing of the actuation mechanism via a linear path of motion that is at least partially defined by the guide member. In some embodiments, the guide member can have grooves that slideably receive rails of the housing of the actuation mechanism. In other embodiments, the guide member may have another type of structure to receive prongs or protuberances of the housing of the actuation mechanism. In yet other embodiments, the guide member may have rails, protuberances or prongs to be received within grooves or apertures of the housing of the actuation mechanism.

In some embodiments, the structure of the article of furniture to which the guide member is affixable can be a tabletop. In other embodiments, the structure may be a seat of a bench or other part of an article of furniture.

In some embodiments, the actuation mechanism can include a biasing mechanism attached between the housing of the actuation mechanism and the guide member to bias the housing of the actuation mechanism to the first position of the housing of the actuation mechanism. For instance, the biasing mechanism is comprised of a spring (e.g. a coil spring, one or more elastomeric springs, etc.).

The first detent mechanism can include a first spring member that contacts or otherwise engages the first detent member to bias the first detent member to the first position of the first detent member. When present, the second detent mechanism can also comprise a second spring member that contacts or otherwise engages he second detent member to bias the second detent member to the second position of the second detent member. For example, the first detent member can have a protuberance adjacent an intermediate portion of the first detent member that contacts a first end of the first spring member and the second detent member can have a protuberance adjacent an intermediate portion of the second detent member that contacts a first end of the second spring member.

The housing of the articulation mechanism can have an opening in which the first and second rotatable members are positioned and can have a first channel, a second channel, and a third channel in communication with that opening. A portion of the first elongated member can pass through the first channel such that the first elongated member is connectable to the first rotatable member, a portion of the second elongated member can pass through the second channel such that the second elongated member is connectable to the second rotatable member, and a portion of the third elongated member can pass through the third channel.

In some embodiments, the guide member is positioned within the housing of the actuation mechanism. A path of travel of the housing along which the housing moves when the housing moves between the first and second positions of the housing extends in a direction that is transverse or perpendicular to a direction at which a path of travel of the first detent member extends and/or a path of travel of the second detent member extends. The path of travel of the first detent member can be the path of travel along which the first detent member moves when the first detent member moves between the first and second positions of the first detent member. The path of travel of the second detent member can be the path of travel along which the second detent member moves when it moves between its first and second positions.

An article of furniture is also provided that can include an embodiment of the latch mechanism. The article of furniture may be a table having a tiltable tabletop. In other embodiments, the article of furniture may be a bench having a tiltable seat.

A method of using the article of furniture is also provided. The method can include the steps of providing a force to move the housing of the actuation mechanism from its first position to its second position and removing the force so that the housing returns from its second position back to its first position. It is contemplated that some embodiments of the method may be utilized to actuate tilting of a tabletop between tilted and horizontal positions or for tilting of the seat of a bench from tilted to horizontal positions.

In some embodiments of the method, the method can also include the step of biasing the housing to cause the housing to return from the second position back to the first position. The biasing is provided by one or more springs.

For embodiments of the method in which the article of furniture is a moveable table (e.g. a table having wheels that support the table on a floor), the method can also include the steps of tilting a tabletop of the table while the force is provided to move the housing of the actuation mechanism from the first position of the housing of the actuation mechanism to the second position of the housing of the actuation mechanism and positioning the table next to other tables to nest the tables such that tabletops of the tables are tilted for nesting of the tables.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of an article of furniture having a latch mechanism and embodiments of the latch mechanism are shown in the accompanying drawings and certain exemplary methods of practicing the same are also illustrated therein. It should be appreciated that like reference numbers used in the drawings may identify like components.

DETAILED DESCRIPTION OF EXEMPLARY EMBODIMENTS

Figure 1:
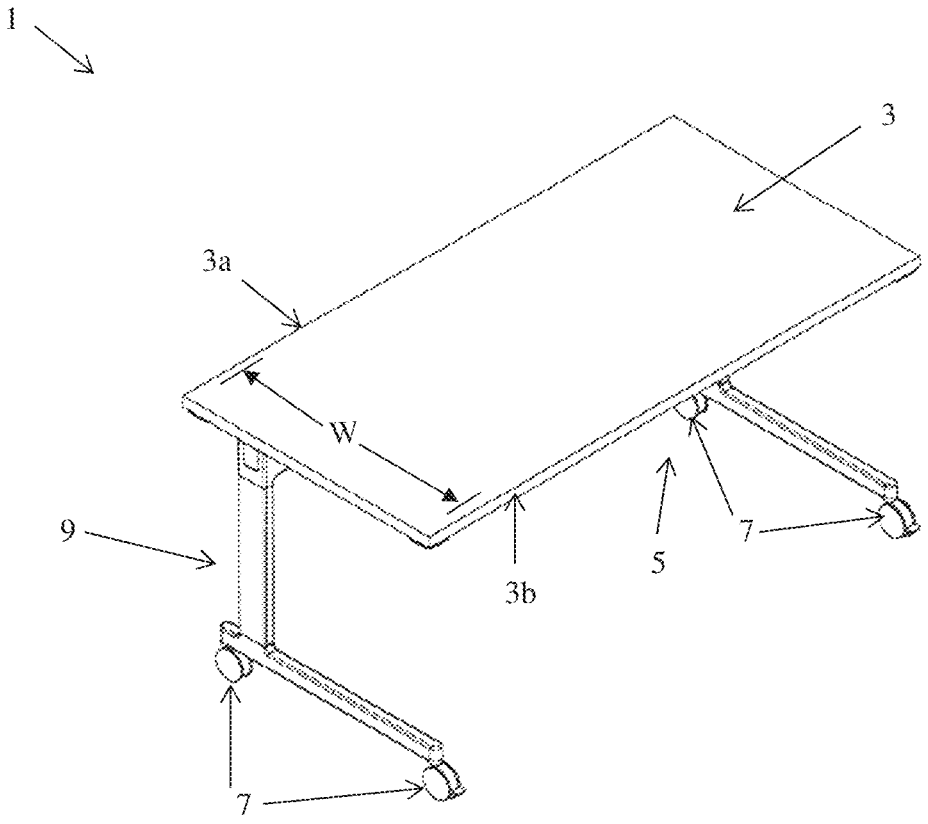
FIG. 1 is a perspective view of a first exemplary embodiment of the article of furniture in a first position.
Figure 2:
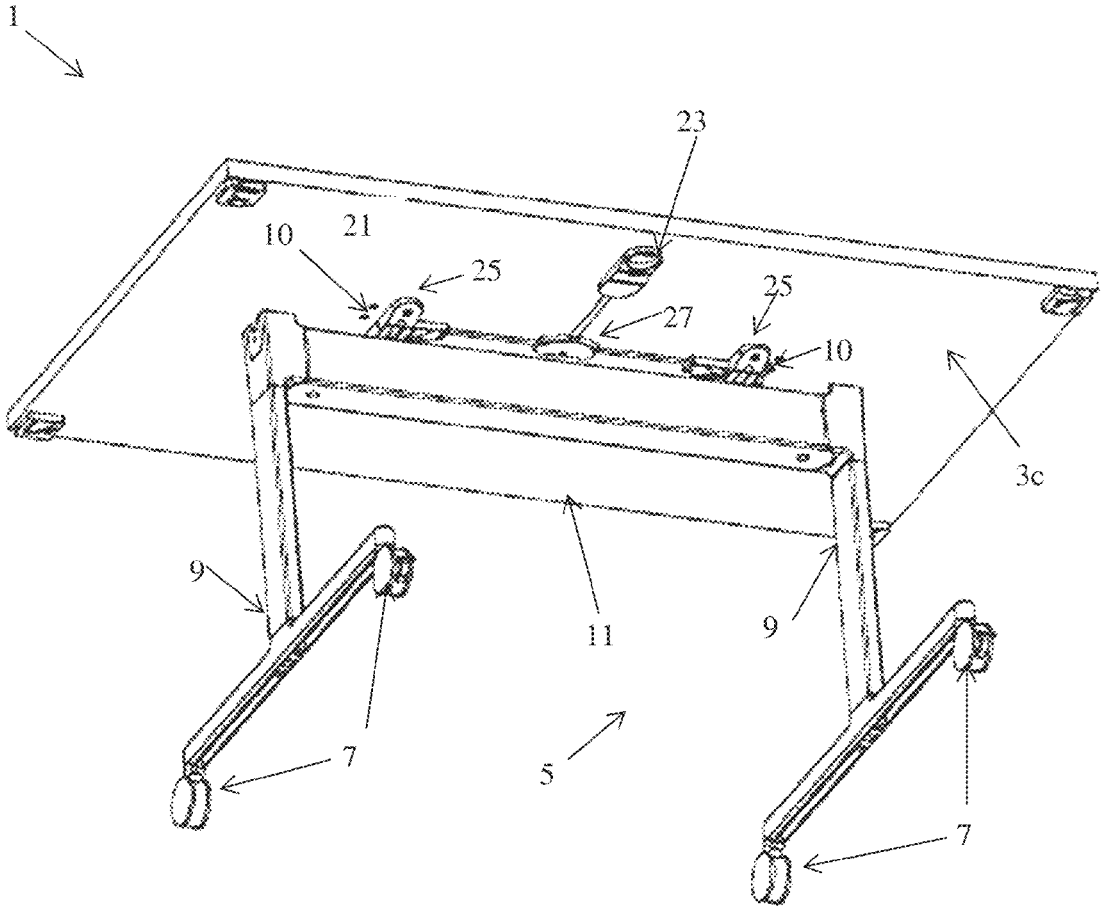
FIG. 2 is a bottom perspective view of the first exemplary embodiment of the article of furniture in the first position.
Figure 3:
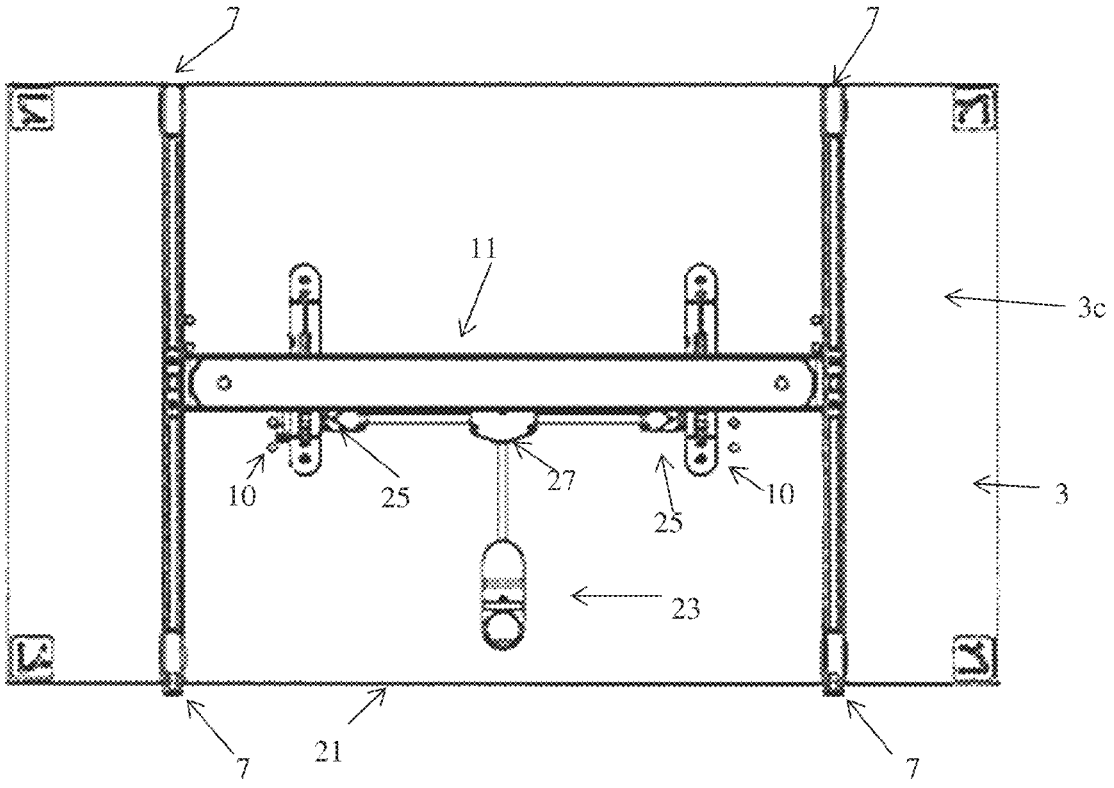
FIG. 3 is a bottom view of the first exemplary embodiment of the article of furniture in the first position.
Figure 4:
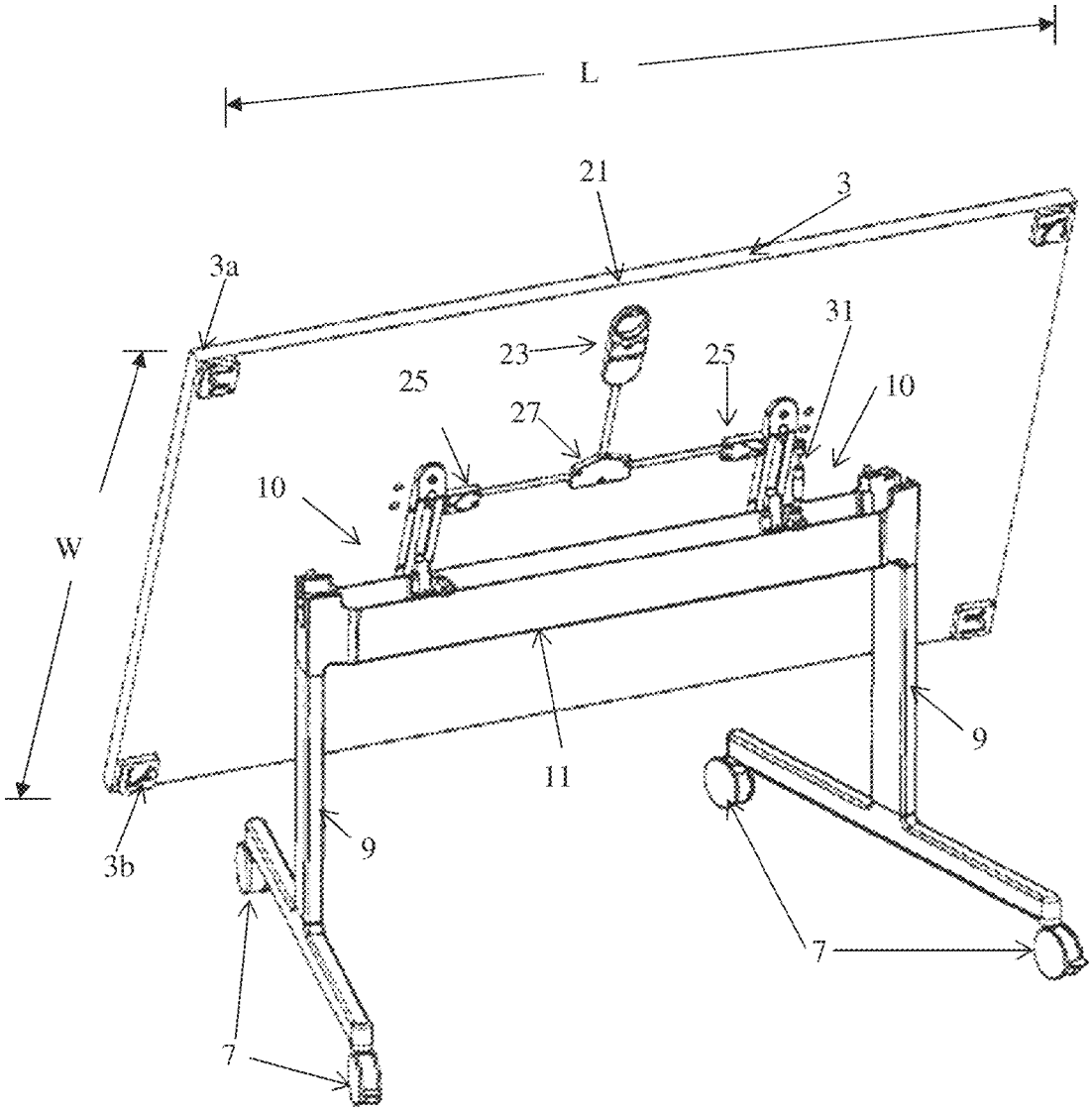
FIG. 4 is a perspective view of the first exemplary embodiment of the article of furniture in a second position.
Figure 5:
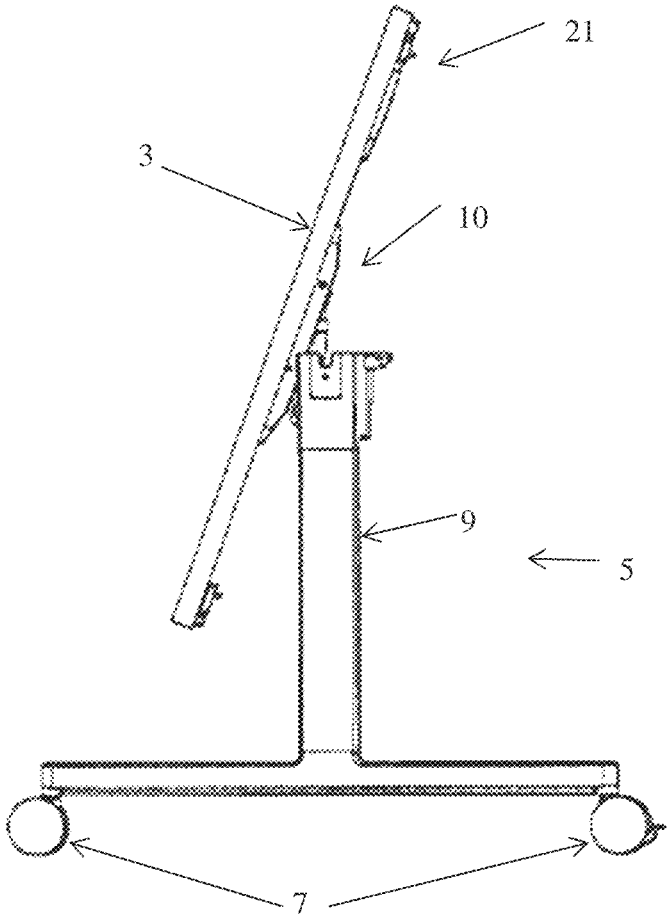
FIG. 5 is a side view of the first exemplary embodiment of the article of furniture in the second position.
Figure 6:
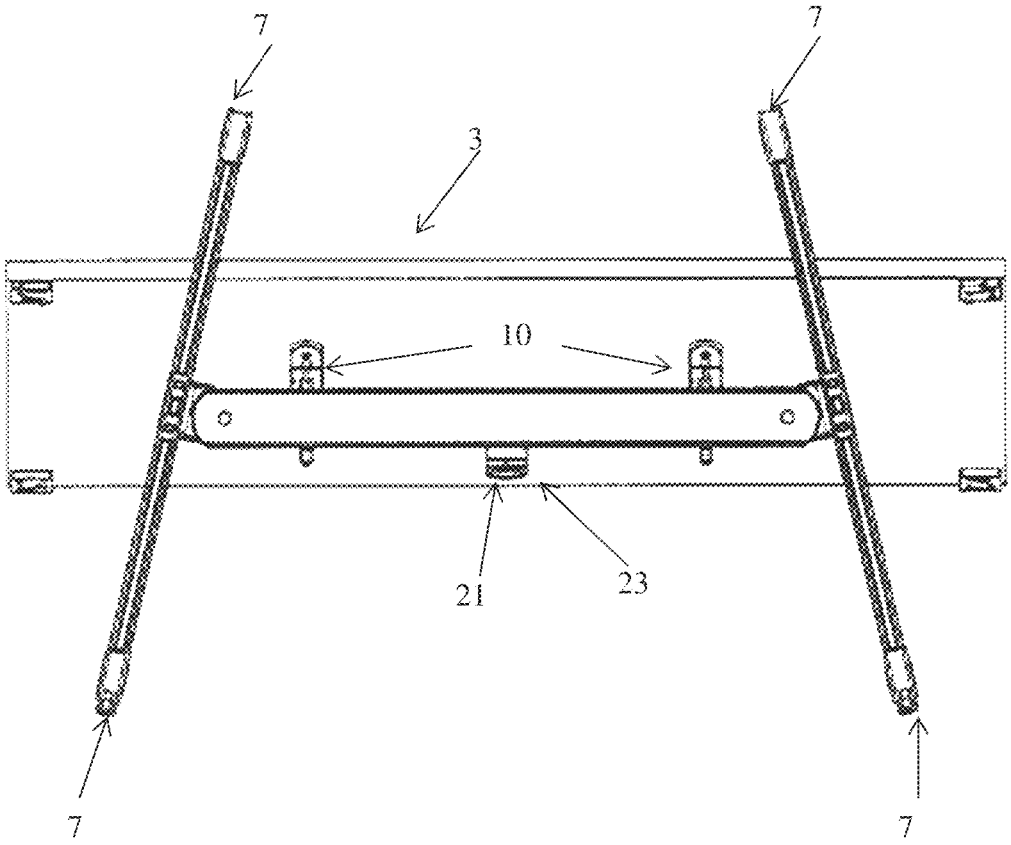
FIG. 6 is a bottom view of the first exemplary embodiment of the article of furniture in the second position.

Referring to FIGS. 1-11, an article of furniture 1 can include a tabletop 3 that is supported by a base 5. The base 5 can include legs 9 that are attached to feet 7. Each foot can be a castor so that the article of furniture 1 is rollable or otherwise moveable along a floor. Alternatively, each foot can be a stationary, non-moving element that engages the floor to support the base on the floor. Each leg 9 can extend vertically from adjacent the feet to which that leg 9 is attached. An upper end portion of each leg may be attached to a cross member 11 that extends between the legs 9. For instance, an upper portion of a first leg can be attached to a first end of the cross member 11 and an upper portion of the second leg can be attached to the second end of the cross member 11 that is opposite the first end of the cross member 11.

The tabletop 3 can be rotatably or tiltably attached to the cross member 11 or other structure of the base 5 so that the tabletop 3 is tiltable about at least one horizontal axis so that the tabletop can be moved from a first position to a second position and also moved from that second position back to its first position. For instance, in some embodiments the tabletop 3 can be attached to the cross member 11 via a tilting mechanism 10. An example of such a tilting mechanism 10 is disclosed in U.S. Pat. No. 9,265,340. The entirety of U.S. Pat. No. 9,265,340 is incorporated by reference herein.

The tilting mechanism 10 that may rotatably or tiltably connect the tabletop 3 to the base 5 can be configured so that only the tabletop's position is moved when the tabletop is rotated between different positions when the tilting mechanism 10 is utilized to adjust the position of the tabletop 3. The tilting mechanism may also move when the tabletop 3 is moved.

Figure 7:
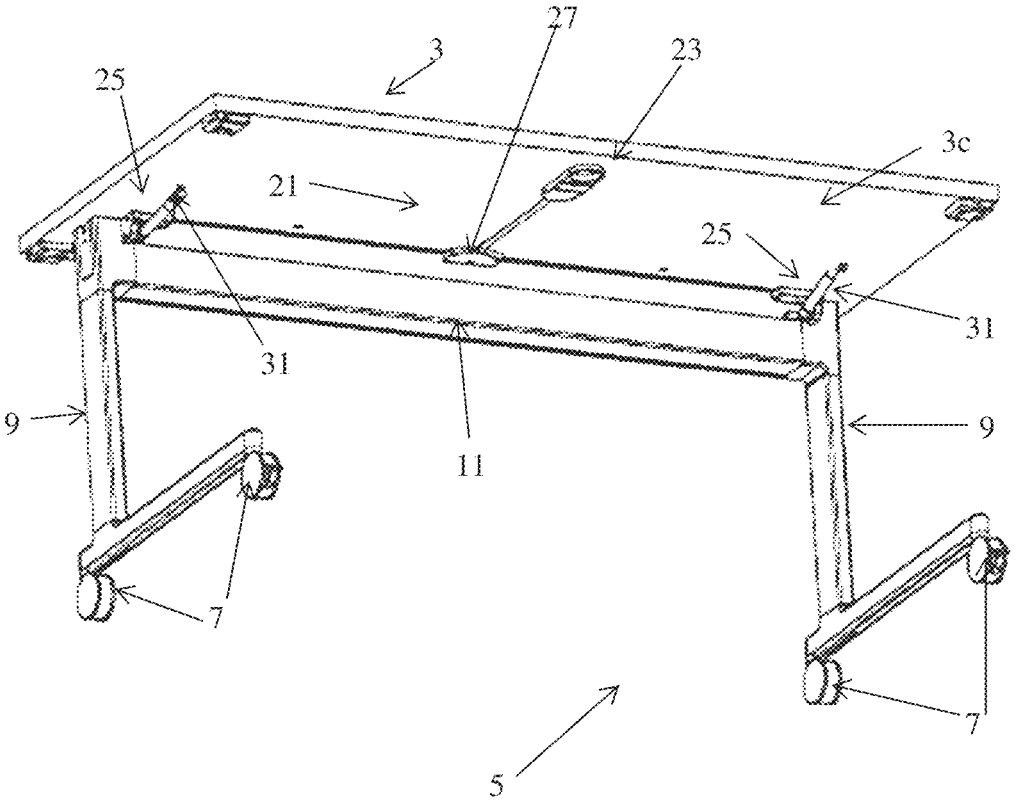
FIG. 7 is a perspective view of a second exemplary embodiment of the article of furniture in a first position.
Figure 8:
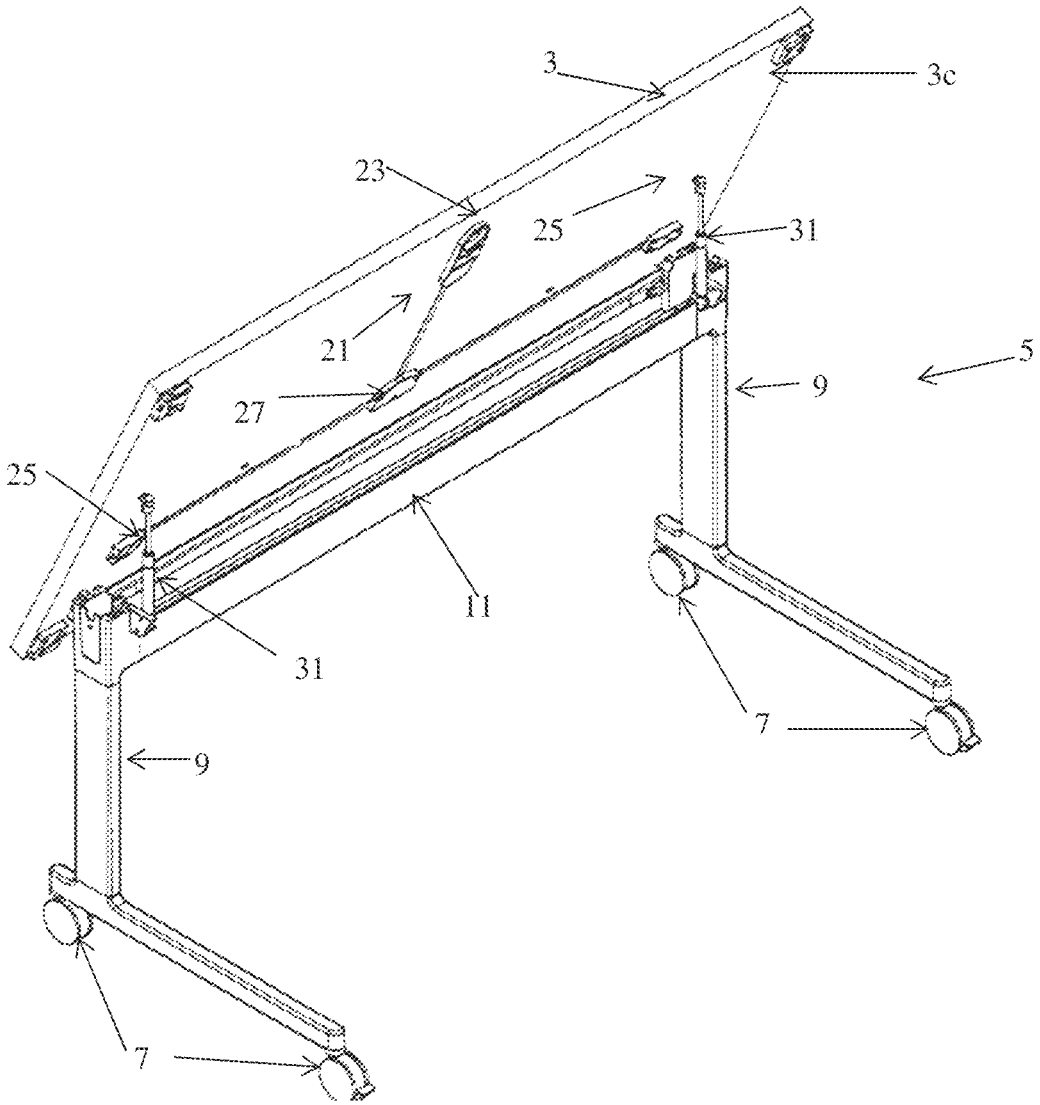
FIG. 8 is a perspective view of a second exemplary embodiment of the article of furniture in a second position.
Figure 9:
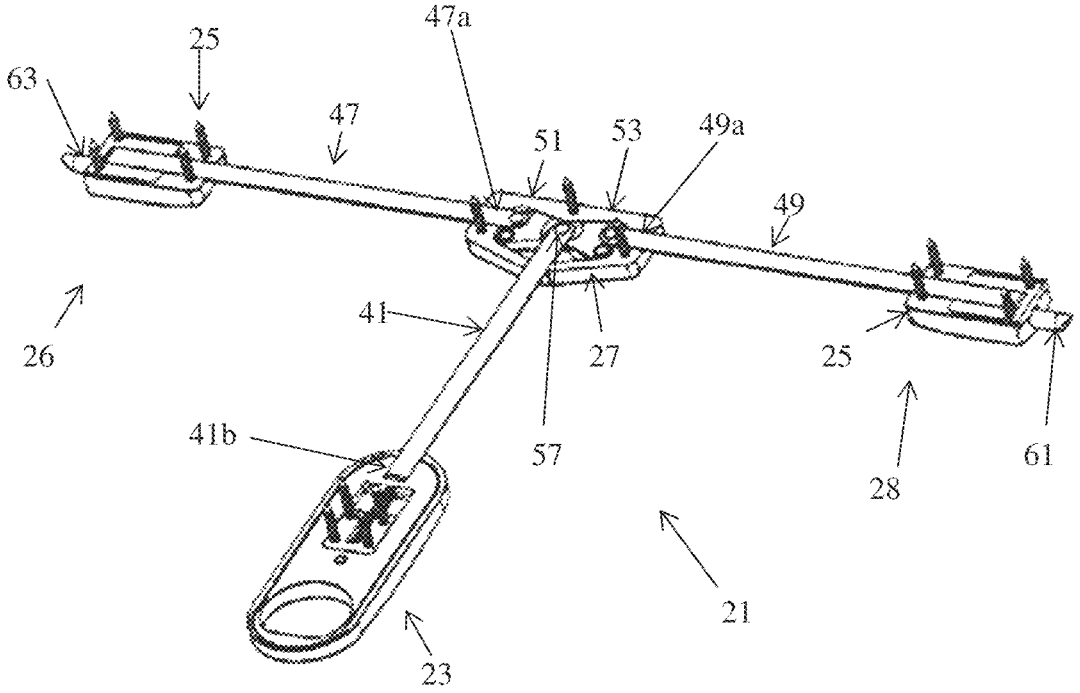
FIG. 9 is a perspective view of an exemplary embodiment of the latch mechanism included in the first and second exemplary embodiments of the article of furniture.
Figure 10:
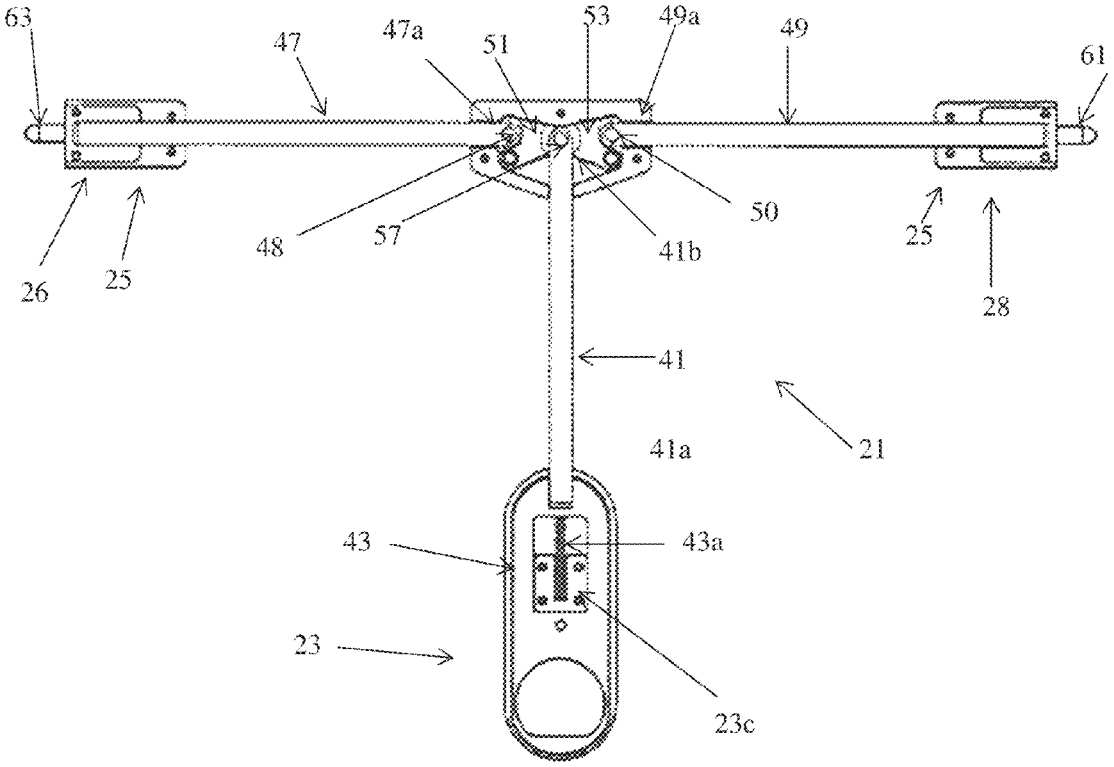
FIG. 10 is a top view of the exemplary embodiment of the latch mechanism included in the first and second exemplary embodiments of the article of furniture.
Figure 11:
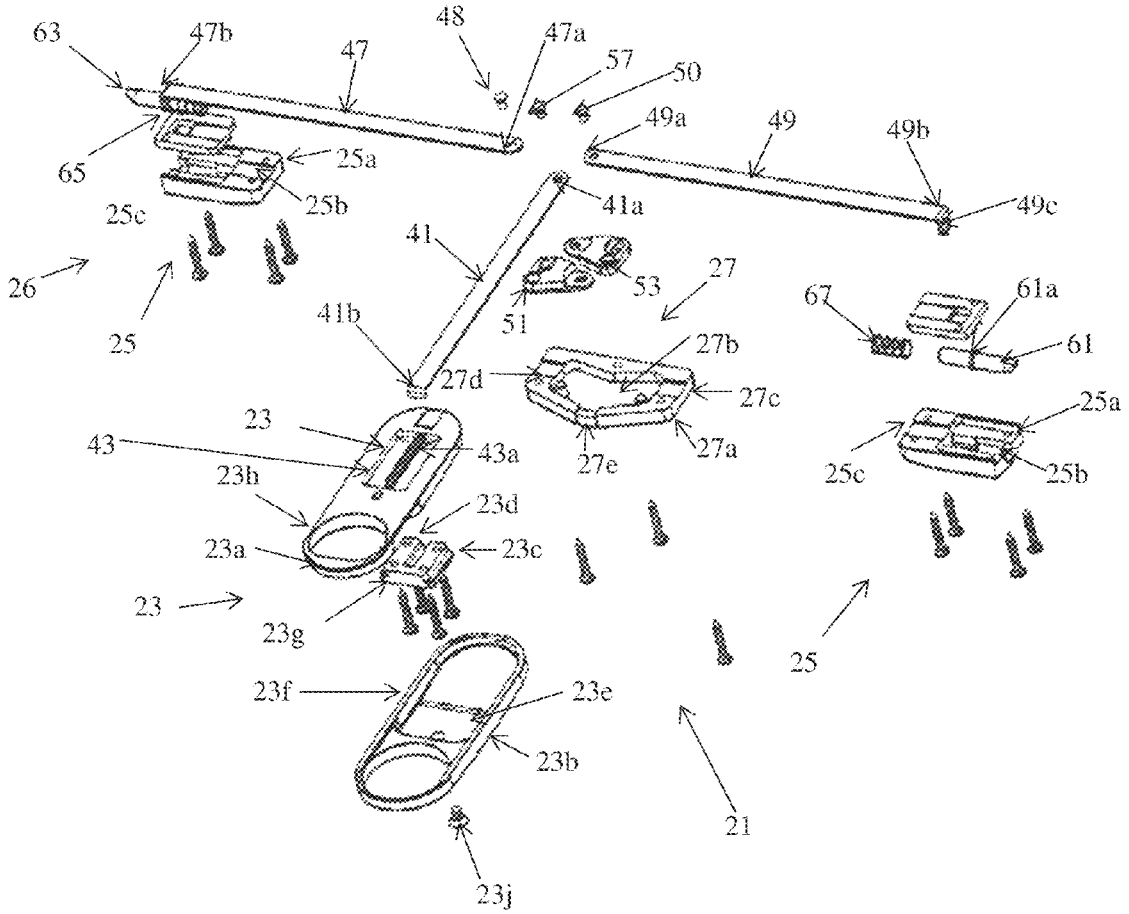
FIG. 11 is an exploded view of the exemplary embodiment of the latch mechanism included in the first and second exemplary embodiments of the article of furniture.

In other embodiments, the tilting mechanism 10 can be configured to be coupled to a leg rotating mechanism so that the legs 9 of the article of furniture twist or rotate when the tabletop 3 is rotated between first and second positions. An example of such a tilting mechanism coupled to leg rotating mechanism is shown in FIGS. 7-8 of this application. An example of such a tilting mechanism configuration is also described in U.S. Pat. No. 9,265,340, the entirety of which is incorporated by reference herein (e.g. tilting mechanism 14 disclosed in U.S. Pat. No. 9,265,340 that is coupled to at least one leg rotating mechanism 13 disclosed in U.S. Pat. No. 9,265,340).

In some embodiments, the first position of the tabletop can be a position in which the tabletop 3 is horizontal or is only slightly inclined or declined (e.g. is within 5-10 degrees of being horizontal). The second position of the tabletop may position the tabletop 3 so that is vertical or is substantially vertical (e.g. is within 45 degrees of being vertical, is within 30 degrees of being vertical, or is within 10 degrees of being vertical, etc.). For instance, the tabletop may have a front edge 3*a* and a rear edge 3*b* when in the first position. The front and rear edges 3*a* and 3*b* may be at the same height or may be close to being at the same height (e.g. within 0-25 centimeters of being at the same height). When the tabletop is moved to its second position, the front edge 3*a* may be located at a position that is significantly higher than the rear edge 3*b*. For instance, the front edge 3*a* may be higher than the rear edge 3*b* by the full width W of the tabletop 3, by no more than the full width W of the tabletop 3, by at least half the width W of the full tabletop, or by about half the width W of the tabletop 3 (e.g. 40-60% of the width W of the tabletop 3 or 45% to 55% of the full width W of the tabletop, etc.).

One or more dampers 31 may also be attached between the tabletop 3 and the cross member 11. Each damper 31 may be configured as a gas spring or other type of damper to help regulate the speed at which the tabletop 3 may move from a use position to a nesting position. Each damper 31 can have a first end attached to the base 5 (e.g. a portion of cross member 11 or a portion of the tilting mechanism 10) and have a second end that is opposite its first end attached to the table top (e.g. the bottom surface of the tabletop 3).

In some embodiments, an end of an extendable arm of a damper 31 that is extendable from a receptacle member of the damper 31 and is also retractable back into the receptacle member of the damper 31 may be attached to the base 5 (e.g. cross member 11, tilting mechanism 10, etc.) while the receptacle member is attached to the tabletop 3 (e.g. the bottom surface of the tabletop 3). In other embodiments, the extendable arm of the damper 31 may be attached to the tabletop 3 (e.g. bottom surface of the tabletop 3, etc.) and the receptacle member of the damper 31 may be attached to the base 5 (e.g. cross member 11, tilting mechanism 10, etc.). The distal end of the extendable arm of the damper 31 that is positioned outside of the receptacle member can be pivotally attached to the base 5 or tabletop 3. The receptacle member of the damper 31 that retains the proximate end of the extendable arm that is moveably retained within a chamber of the receptacle member may also be pivotally attached to the base 5 or the tabletop 3.

The motion of the tabletop 3 between its first and second positions can be actuated and/or permitted via a latch mechanism 21 that may be attached to the bottom surface 3*c* of the tabletop 3. The latch mechanism 21 may be adjustable from a locked position to an unlocked position. In some embodiments, the latch mechanism 21 may be biased to its locked position so that a user must manipulate the latch mechanism to provide a force for moving the latch mechanism to the unlocked position. When the latch mechanism 21 is in the unlocked position, the tabletop 3 may be rotatable via the tilting mechanism 10 that tiltably connects the tabletop 3 to the base 5 from the tabletop's first position to its second position. When the latch mechanism is in the locked position, the latch mechanism 21 can be configured to prevent tilting of the tabletop 3 from the first position to the second position.

The latch mechanism 21 can include an actuator mechanism 23 that is configured so that a user may manipulate the actuator mechanism 23 to adjust the latch mechanism 21 from its locked position to its unlocked position to facilitate adjustment of the tabletop from its first position to its second position. The latch mechanism 21 may also include detent mechanisms 25 and an articulation mechanism 27 that is positioned between the detent mechanisms 25 and the actuation mechanism 23.

The detent mechanisms 25 can include a first detent mechanism 26 and a second detent mechanism 28. The first detent mechanism 26 can include a first elongated member 47 that extends between a first moveable detent member 63 and the articulation mechanism 27. A first end 47*a* of the first elongated member 47 can be attached to a first rotatable member 51 that is rotatably positioned within a housing 27*a* of the articulation mechanism 27. The first end 47*a* may be pivotally attached to the first rotatable member 51 via a pivot pin 48 or other type of connector or connection mechanism. A second end 47*b* of the first elongated member 47 is positioned opposite the first end 47*a*. The second end 47*b* can be affixed to the first detent member 63 or otherwise attached to the first detent member 63. For instance, the second end 47*b* can have a hole through which a portion of the first detent member 63 extends that is sized and configured to attach the first detent member to the second end 47*b*. A first spring member 65 can be attached between the second end 47*b* and a housing 25*a* of the first detent mechanism 26 to bias the detent member 63 to an extended position in which the first detent member 63 extends out of the housing 25*a* and into a first aperture formed in a structure of the base 5 or attached to the base 5 for locking the position of the tabletop in its first position. In some embodiments, the first aperture in which the first detent member 63 is positionable into can be an aperture formed in the tilting mechanism 10 or an aperture defined by a cross member 11 or a bracket or other structure attached to the cross member 11 or other component of the base 5.

A protuberance that extends along a perimeter (e.g. a circumference or other type of perimeter) of an intermediate portion or middle portion of the first detent member 63 (e.g. a portion located between the opposite ends of the detent member) may contact a first end of the first spring member 65 and a second end of the spring member 65 that is opposite its first end may contact an inner wall defined by the housing

25*a* of the detent mechanism that may be located within an inner opening 25*b* defied in the housing 25*a* to bias the first detent member to its extended, locking position. The first spring member 65 may be a coil spring or other type of spring member for such embodiments. The first spring member 65 may define or have an inner channel or other type of inner aperture that is sized to receive a portion of the first detent member 63 between the second end of the first spring member 65 that may be in contact with or engagement with an inner wall of the housing 25*a* and the first end of the first spring member 65 that is in contact with or otherwise engaging a protuberance of the intermediate portion of the first detent member 63.

The second detent mechanism 28 can include a second elongated member 49 that extends between a second moveable detent member 61 and the articulation mechanism 27. A first end 49*a* of the second elongated member 49 can be attached to a second rotatable member 53 that is rotatably positioned within the housing 27*a* of the articulation mechanism 27. The first end 49*a* of the second elongated member 49 may be pivotally attached to the second rotatable member 53 via a pivot pin 50 or other type of connector or connection mechanism. A second end 49*b* of the second elongated member 49 can be positioned opposite the first end 49*a*. The second end 49*b* can be affixed to the second detent member 61 or otherwise attached to the second detent member 61. For instance, the second end 49*b* can have a hole 49*c* through which a portion of the second detent member 63 extends that is sized and configured to attach the second detent member 61 to the second end 49*b*. A second spring member 67 can be attached between the second end 49*b* and a housing 25*a* of the second detent mechanism 28 to bias the second detent member 61 to an extended position in which the second detent member 61 extends out of the housing 25*a* and into a second aperture formed in a structure of the base 5 or attached to the base 5 for locking the position of the tabletop 3 in its first position. In some embodiments, the second aperture in which the second detent member 61 is positionable into can be an aperture formed in the tilting mechanism 10 or an aperture defined by a cross member 11 or a bracket or other structure attached to the cross member 11 or other component of the base 5.

The second spring member 67 may have a first end that contacts or otherwise engages a protuberance 61*a* or ring element attached to an intermediate portion or middle portion of the second detent member 61. The second end of the second spring member 67 may contact an inner wall, rib, or other element defined in the housing 25*a* that is positioned in or adjacent an opening 25*b* that is configured to retain at least a portion of the second detent member 61. The second spring member 67 may be a coil spring or other type of spring element for such embodiments. The second spring member 67 may include or define an inner channel that is sized to receive a portion of the second detent member between the second end of the second spring member 67 and the first end of the second spring member 67 that contacts or otherwise engages the peripherally positioned protuberance 61*a* attached to the intermediate portion of the second detent member 61.

In some embodiments, each protuberance 61*a* that may be positioned on the periphery of the first and second detent members 63 and 61 extends along a circumference or other portion of the perimeter of the width or thickness of the detent member may be a ring element attached to the detent member. In other embodiments, the protuberance 61*a* may be a peripheral wall, lip, or other type of protuberance that is formed or otherwise defined on the exterior surface of the detent member that extends along a circumference or other portion of the perimeter of the width or thickness of the detent member.

In some embodiments, the opening or mouth of the second aperture that receives the second detent member 61 can face towards the opening or mouth of the first aperture that receives the first detent member 63. For such embodiments, the first and second detent members 63 and 61 may move toward each other when the latch mechanism is moved to an unlocked position in which the first and second detent members 63 and 61 are retracted out of the first and second apertures. The first and second detent members 63 and 61 may move away from each other when moved from their retracted, unlocked positions to their extended locked positions located within the first and second apertures.

In some embodiments, the path of travel of the retraction and extension of the first and second detent members 63 and 61 may be a linear path of travel. That path of travel for each detent member can be defined by an opening 25*b* that is defined in the housing 25*a* of the detent mechanism 25, the spring member engaging that detent member and/or motion of the elongated member to which that detent member is attached. The path of travel that is at least partially defined by the opening 25*b* can be configured so that the detent member retracts into the opening 25*b* via a mouth of that opening that is at least partially defined in the exterior surface of the housing 25*a* and the shape of the opening 25*b* formed within the housing 25*a*.

The articulation mechanism 27 can be positioned between the actuation mechanism 23 and the detent mechanisms 25 and be configured so that a force provided by a user via the actuation mechanism 23 is translated to the detent mechanisms 25 to move those detent mechanisms from their locked positions to their unlocked positions while also permitting the detent mechanisms 25 to be moved back to their locked positions when that force from a user is removed. The articulation mechanism 27 can include a housing 27*a* that has a central opening 27*b* that is sized to receive a first rotatable member 51 and a second rotatable member 53. The housing 27*a* of the articulation mechanism 27 can also include a first channel 27*d* that is in communication with the opening 27*b* that is sized and configured to permit the first elongated member 47 to extend from the first rotatable member, through this first channel 27*d* to the first detent mechanism 26. The housing 27*a* can also define a second channel 27*c* that is in communication with the opening 27*b* that is sized and configured to permit the second elongated member 49 to extend from the second rotatable member 53 to the second detent mechanism 28. The first and second channels 27*d* and 27*c* can each be sized and shaped as a groove, recess, furrow, chamber, or other type of channel. In some embodiments, the first and second channels 27*d* and 27*c* can each be polygonally shaped or otherwise configured to define a linear length along which an elongated member (e.g. first elongated member 47 or second elongated member 49) can extend along such that the elongated member extends linearly through the channel. For such embodiments, each channel 27*d* and 27*c* can also be configured to have a width that is sufficient to permit the width of that elongated member to be flatly positioned in that channel.

The housing 27*a* of the articulation mechanism 27 can also include a third channel 27*e* that is defined by the housing to be in communication with the opening 27*b* to receive a first end portion 41*a* of a third elongated member 41 so that the third elongated member 41 can extend from the actuation mechanism 23 to the first and second rotatable members 51 and 53 of the articulation mechanism 27 positioned in the opening 27*b*. The third channel 27*e* can be sized and configured to be polygonally shaped or otherwise configured to define a linear length along which an elongated member (e.g. third elongated member 41) can extend along such that the elongated member extends linearly through the channel. For such embodiments, the third channel 27*e* can also be configured to have a width that is sufficient to permit the width of that elongated member to be flatly positioned in that channel. The first end portion 41*a* can also be attached to the first and second rotatable members via a connector 57 that can pass through a hole in the first end portion 41*a* and holes in the first and second rotatable members 51 and 53. These holes may each be aligned with each other so that the connector 57 can linearly pass through all of these holes for connecting the third elongated member 41 to the first and second rotatable members 51 and 53 at a connection point. The connector 57 can be configured so that it defines a pivot point or axis of rotation for both the first rotatable member 51 and the second rotatable member 53. In some embodiments, the connector 57 may be a pin, bolt, screw, or other type of fastener. In other embodiments, another type of connection mechanism may be used instead of a fastener to connect the third elongated member 41 to the first and second rotatable members 51 and 53, such as an adhesion mechanism, welding, or other type of connection mechanism.

The first and second rotatable members 51 and 53 may have end portions that are sized and configured to permit their end portions to overlap each other so that their holes may be aligned with each other in the opening 27*b*. For example, the first rotatable member 51 may have its inner side end configured to lay underneath the inner side of the second rotatable member 53 so that the holes of the first and second rotatable members are linearly aligned with each other so that a shaft of the connector 57 can pass through those holes as well as the hole in the first end portion 41*a* of the third elongated member 41. As another example, the second rotatable member 53 may have its inner side end configured to lay underneath the inner side of the first rotatable member 51 so that the holes of the first and second rotatable members are linearly aligned with each other so that a shaft of the connector 57 can pass through those holes as well as the hole in the first end portion 41*a* of the third elongated member 41. The inner sides of the first and second rotatable members 51 and 53 may also be shaped or otherwise configured to facilitate rotatable motion of each rotatable member about the pivot axis or rotational axis that may be defined by the connector 57 (e.g. the axis of rotation that may be defined by the shaft of the connector 57 passing through the holes of the first and second rotatable members 51 and 53 and the first end portion 41*a* of the third elongated member 41). For instance, each inner side portion may include recesses or other profiles that are rounded or curved to facilitate rotation of the first and second rotatable members 51 and 53 about the axis of rotation defined by the connector 57.

The third elongated member 41 may extend from its first end portion 41*a* attached to the first and second rotatable members 51 and 53 inside the opening 27*b* of the housing 27*a* of the articulation mechanism 27 to its second end portion 41*b* that may be opposite its first end portion 41*a*. The second end portion 41*b* can be attached to the actuation mechanism 23. For instance, the second end portion 41*b* can be attached to a moveable component of the housing of the articulation mechanism or to a moveable component of the actuation mechanism positioned inside of or moveably attached to that housing.

The actuation mechanism 23 can include a housing that is at least partially formed by a first component 23*a* being connected to a second component 23*b*. A fastener 23*j*, such as a bolt or screw, may connect the first and second components 23*a* and 23*b* together. Another type of connection mechanism may alternatively (or also) be used to connect the first and second components 23*a* and 23*b* together. For instance, one or more mating profiles or interlocking profiles may be utilized to connect the first and second components together and/or an adhesive or welding may be used for connecting the first and second components 23*a* and 23*b* together.

When connected together, the first and second components 23*a* and 23*b* may form a housing that has a cavity 23*e* and an opening 23*i* that is sized to receive a guide member 23*c* that may be fastened or otherwise attached to a bottom surface of the tabletop 3. The guide member 23*c* may be immovably attached to the tabletop so that the guide member is not moveable relative to the tabletop (e.g. is screwed, adhered, or otherwise immovably affixed to the bottom surface of the tabletop 3). The housing formed via connection of the first and second components 23*a* and 23*b* may be moveably attached to the guide member 23*c* located within the opening 23*i* and cavity 23*e* such that the housing is linearly moveable relative to the guide member 23*c*. The housing may have ribs, rails 23*f*, or other type of protuberances or projections that may moveably fit within grooves 23*g* formed on opposite sides of the guide member 23*c* so that the grooves 23*g* at least partially define the path of travel of the housing formed by the first and second components 23*a* and 23*b*. For instance, when the housing is moved, rails 23*f* may slide along the grooves 23*g* so that the housing moves linearly relative to the guide member 23*c* along a path defined by the grooves 23*g* and the rails 23*f* slideably positioned in the grooves 23*g*.

In alternative embodiments, the guide member 23*c* may have rails or other projections or protuberances that extend form opposite sides of the guide member 23*c* and the housing defined by the first and second components 23*a* and 23*b* being connected together may have grooves for receiving those rails to facilitate the relative linear motion of the housing relative to the guide member. For such embodiments, the housing may slide relative to the guide member 23*c* via a linear path defined by the rails being positioned within those grooves such that the housing can slide along the rails of the guide member 23*c*.

The extent to which the housing formed by the first and second components 23*a* and 23*b* may move relative to the guide member 23*c* can be defined by a length of the opening 23*i* and/or cavity 23*e* in which the guide member is located within the housing. When the housing is in a first position, the guide member 23*c* may be located adjacent a first end of the opening 23*i* and/or cavity 23*e*. For instance, a first end of the guide member 23*c* may contact a portion of the housing defining the first end of the opening 23*i* and/or cavity 23*e*. When the housing is moved relative to the guide member 23*c* via a force provided by a user to its second position, the housing may be prevented from further motion when the guide member 23*c* is positioned at the second end of the opening 23*i* and/or cavity 23*e* such that a portion of the housing that defines the second end of the opening 23*i* and/or cavity 23*e* contacts the second end of the guide member 23*c* that is opposite its first end. In other embodiments, a stopper, wall, or other structure may be located within the cavity 23*e* and/or opening 23*i* adjacent to opposite sides of the cavity 23*e* and/or opening 23*i* to contact the guide member 23*c* when the housing is moved between its first and second positions to define the extent to which the housing may move in a first direction from its first position to its second position and the extent to which the housing may move in a second direction that is opposite the first direction from its second position to its first position.

The first component 23*a* can include an end having an opening 23*h* and the second component 23*b* can also include an opening so that when the housing is formed by connection of the first and second components 23*a* and 23*b*, there is an opening that is sized and configured to permit a user to place his or her hand or fingers of that user's hand into the opening to provide a force for moving the housing so that the housing is slideable or otherwise moveable relative to the guide member 23*c* attached within the housing and/or adjacent an intermediate portion of the housing and/or end portion of the housing opposite this opening. In some embodiments, the force that is applied by the user may be a pulling force to pull the housing to move the housing relative to the guide member 23*c*. In other embodiments, the force that is applied may be a pushing force to push the housing to move the housing relative to the guide member 23*c*.

The actuation mechanism 23 can also include a biasing mechanism 43. The biasing mechanism 43 can include a third spring 43*a* or other type of biasing element that is configured to help bias the housing of the actuation mechanism in a first position that correspond to a locked position for the first and second detent members 63 and 61 of the detent mechanisms. The third spring 43*a* may be a coil spring, an elongated elastomeric member, or other type of spring element that has a first end and a second end opposite its first end. The guide member 23*c* can include an opening 23*d* (e.g. a recess, channel, or cavity) that is sized and configured to retain the first end of the third spring 43*a* as well as an intermediate portion of the third spring 43*a* adjacent to this first end. The first end of the third spring 43*a* may be attached to the guide member adjacent to the opening 23*d*. The second end of the third spring 43*a* may be attached to the first component 23*a* and/or the second component 23*b* adjacent to an end of the opening 23*i* and/or cavity 23*e* that is opposite the end of the opening 23*i* and/or cavity 23*e* at which the guide member 23*c* and/or first end of the third spring 43*a* may be positioned. The opening 23*d* of the guide member can be configured so that when the housing of the actuation mechanism 23 is moved relative to the guide member 23*c* from its first position to its second position, the second end of the third spring 43*a* is moved closer to the first end of the third spring 43*a* attached to the guide member 23*c* as the third spring 43*a* is compressed via motion of the housing such that the opening 23*d* receives a greater portion of the spring therein as the third spring 43*a* is compressed. For instance, when a user applies a force to the housing to move the housing relative to the guide member 23*c* from a first position in which the detent members are in their locked positions to a second position of the housing that corresponds to movement of the detent members to their unlocked positions, the third spring 43*a* may be compressed as the user applies a force to overcome the force exerted by the third spring 43*a* that may bias the position of the housing to its first position via motion of the housing causing the third spring 43*a* to compress and causing a greater portion of the third spring 43*a* to move into the opening 23*d* of the guide member 23*c*. When the user removes the applied force, the spring may decompress and thereby extend back to its previous length so that its second end moves farther away from its first end, which can also drive motion of the housing relative to the guide member from the second position to its original, first position. Such motion may also result in moving the detent members of the detent mechanisms 25 back to their locked positions.

The compression of the third spring 43*a* that can result when the housing of the actuation mechanism 23 is moved from its first position to its second position may also result in the length of the third spring 43*a* changing from a first length to a second length that is shorter than the first length. Decompression of the third spring 43*a* that can occur when the housing of the actuation mechanism 23 is moved from its second position to its first position may also result in the length of the third spring 43*a* changing from its second length to its first length, which is longer than the second length.

As discussed elsewhere herein, the latch mechanism 21 can be manipulated by a user to allow the tabletop 3 to be moved from a first position to a second position. Operation of the latch mechanism 21 by a user can occur such that a user uses his or her hand or one or more fingers of the user's hand to provide a force on a movable housing of the actuation mechanism 23. The housing may move linearly relative to the guide member 23*c* when the user provides a force that overcomes a biasing force exerted by the third spring 43*a* and/or first and second springs 65 and 67. Motion of the housing from its first position to its second position can cause the second end 41*b* of the third elongated member to move with the housing of the actuation mechanism 23 away from the housing 27*a* of the articulation mechanism 27. This motion may be a linear motion. The moving away of the third elongated member 41 can cause the first end 41*a* of the elongated member to move linearly away from the housing 27*a* of the articulation mechanism such that a portion of the third elongated member passes out of the third channel 27*e*. Connector 57 that is attached to the first end 41*a* of the third elongated member 41 moves with the third elongated member such that this connector also moves linearly with the third elongated member. The motion of the third elongated member 41 and connector 57 causes the first and second rotatable members 51 and 53 to rotate about the connector 57.

Rotation of the first rotatable member 51 driven by the motion of the third elongated member 41 moving away from the articulation mechanism 27 causes that first end 47*a* of the first elongated member 47 to move away from the first detent mechanism 26 and into the opening 27*b* of the articulation mechanism by a portion of the first elongated member moving through the first channel 27*d* and into the opening 27*b* of the housing 27*a* of the articulation mechanism 27 This motion of the first elongated member 47 causes the first detent member 63 to move into the housing 25*a* of the first detent mechanism 26 and out of an aperture in which it may be positioned that is located in structure of the base 5 or a structure of the tilting mechanism 10 attached to the base 5 so that the detent member is moved out of its locked position and outside of that structure into an unlocked position. Motion of the first detent member 63 into the housing 25*a* of the first detent mechanism 26 may cause the first spring member 65 to compress.

Rotation of the second rotatable member 53 also drives motion of the second elongated member 49 at the same time rotation of the first rotatable member 51 is driven by the motion of the third elongated member 41. The rotation of the second rotatable member causes the first end 49*a* of the second elongated member 49 to move further into the opening 27*b* such that a portion of the second elongated member 49 passes through the second channel 27*c* and into the opening 27*b* so that the second elongated member 49 moves away from the housing of the second detent mechanism 28. This motion of the second elongated member 49 causes the second detent member 61 attached to the second end 49*b* of the second elongated member 49 to move further into the housing 25*a* of the second detent mechanism 28 so that the second detent member 63 is moved from its locked position that is located in a structure of the base 5 or a structure of the tilting mechanism 10 attached to the base 5 to an unlocked position in which that detent member is positioned outside of that structure. Motion of the second detent member 61 into the housing 25*a* of the second detent mechanism 28 may cause the second spring 67 to compress.

It should be appreciated that compression of the first and second spring members 65 and 67 can result in the length along which these spring extend from their first ends to their second ends to change from a first length to a second length that is shorter than the first length. When these springs decompress from their compressed positions, the lengths of the springs may correspondingly also change from the second length to the first length that is longer than the second length.

In some embodiments, motion of the first and second detent members from their locked positions to their unlocked positions may be a linear motion that is in opposite directions. The directions of motion may be parallel to each other. The direction of motion of the first and second detent members 63 and 61 may be a direction of motion that is perpendicular to the direction of motion of the moveable housing of the actuation mechanism 23. In some embodiments, the paths of travel that the detent members move along when moving between their locked and unlocked positions may be paths that extend in a direction that is transverse to a path of motion that the housing of the actuation mechanism 23*a* may move along when the detent members and the housing are moved between their first and second positions (e.g. between their locked and unlocked positions). For example the path of travel of the first and second detent members may each extend along a path of travel that extends along a length L of the tabletop 3 and the path of motion of the moveable housing of the actuation mechanism 23 may extend along a path of travel that extends along the width W of the tabletop.

After the actuation mechanism is manipulated by a user to move the housing from its first position to its second position, which causes the first and second detent members 63 and 61 to move from their locking positions to their unlocked positions, the user may be able to provide an upward force on a side of the tabletop or a downward force on a side of the tabletop to cause the tabletop 3 to flip from its first position to its second position. After the tabletop 3 is flipped to its second position, the article of furniture may then be moved next to other articles so positioned for compact nesting of the articles of furniture and/or storage of the articles of furniture so that the article of furniture takes up less floor space (e.g. less area of a floor space).

When the user releases the housing of the actuation mechanism 23, the first spring member 65, second spring member 67, and third spring 43*a* may each extend from their compressed positions to their decompressed positions, which can provide a biasing force that functions to move the first and second detent members 63 and 61 from their unlocked positions to a more extended position out of the housings 25*a* of the first and second detent mechanisms 26 and 28 and, at the same time, also causes the third elongated member 41 to move toward the articulating mechanism 27 such that the first end 41*a* of the third elongated member 41 moves further inward via the third channel 27*e* into the housing 27*a* of the articulation mechanism 27 to return the housing of the actuation mechanism 23 to move relative the guide member 23*c* so that it moves from its second position back to its first position.

The motion of the first detent member 63 is also facilitated via the motion of the first elongated member 47 being moved away from the housing 27*a* of the articulation mechanism 27 toward the housing of the first detent mechanism 26 such that a portion of the first elongated member 47 passes from the opening 27*b* of the housing into the first channel 27*c* . The motion of the second detent member 61 is also facilitated via the motion of the second elongated member 49 being moved away from the housing 27*a* of the articulation mechanism 27 toward the housing of the second detent mechanism 28 such that a portion of the second elongated member 49 passes from the opening 27*b* of the housing into the second channel 27*d*.

If the user releases the actuation mechanism 23 after the tabletop 3 has been moved to its second position or is in the process of being moved to its second position, the first and second detent members 63 and 61 may not extend into apertures formed in structures of the base 5 and/or tilting mechanism 10 of the article of furniture 1. If the user releases the actuation mechanism 23 when the tabletop 3 is in its first position, the detent members may extend back into these apertures.

When the user wishes to move the tabletop 3 from its second position back to its first position, the user need not provide any force on the actuation mechanism 23. The user may simply provide a force for causing rotation of the tabletop 3 to return the tabletop to its first position. The first spring member 65, second spring member 67, and third spring 43*a* may each compress as the detent members 63 and 63 engage structures that they may pass by during the motion of the tabletop 3 back to its first position so that the housing of the actuation mechanism 23 and detent members move as needed to facilitate positioning of the tabletop 3 back to its first position. When the tabletop 3 is positioned in the desired first position, the detent members and housing of the actuation mechanism 23 may automatically be moved via the biasing force provided by the first spring member 65, second spring member 67, and third spring 43*a* so that the first and second detent members 63 and 61 are moved into their locked positions within apertures of the structures of the base 5 and/or tilting mechanism 10 while the housing of the actuation mechanism 23 is also returned to its first position. In other embodiments, a user may have to adjust a locking mechanism, actuate the latch mechanism, or provide a force sufficient to overcome a tabletop gripping mechanism that may engage a portion of the tabletop 3 to help maintain the tabletop in its second position for moving the tabletop 3 from its second position to its first position (e.g. a work position in which the work surface of the tabletop is horizontal or substantially horizontal).

Methods of stacking or nesting tables or other articles of furniture are also provided. Embodiments of the method may include moving a tabletop 3 into its first position for use of the tabletop as a work surface. Thereafter, the actuation mechanism 23 may be manipulated to move the first and second detent members 63 and 61 to their unlocked positions and, while held in those unlocked positions via a user's application of force, the tabletop may be moved out of its first position. The tabletop 3 may then be moved to its second position and subsequently moved along a floor to be nested and/or stored next to other articles of furniture having their tabletops 3 in their second position. When a user desires to use the article again, the user may move the article out of its nested and/or stowed position and move the article of furniture along a floor to a desired location. The tabletop may then be moved from its second position back to its first position. The user or others may then use the tabletop 3 as a work surface for a meeting, performing work, for training, or for another type of activity.

Embodiments of the article of furniture may be configured as a table having a tabletop 3. In other embodiments, it is contemplated that the article of furniture may be configured as a seating device or other type of furniture. For instance, the tabletop 3 could alternatively be configured as an elongated seat of a bench that is supported on a floor by a base. For such an embodiment, the latch mechanism 21 could be positioned on an underside of the seat of the bench.

It should be appreciated that embodiments of the latch mechanism and furniture having such a latch mechanism can be configured differently. For example, the guide member 23*c* may be configured to be attached adjacent to the housing of the actuation mechanism such that the guide member 23*c* is outside of the housing of the actuation mechanism 23 and engages opposite sides of the housing of the actuation mechanism 23. For such an embodiment, the guide member may have stops defined therein or attached thereto to control an extent of travel for the housing as it moves between its first and second positions. As another example, the shape and size of the tabletop, work surface or other structure of the furniture can be any of a number of different shapes and sizes. In some embodiments, the tabletop can be defined by one unitary structure (e.g. a tabletop formed of one unitary piece of stone, wood, composite material, polymeric material, or metal) or by interconnected structures fastened or otherwise joined together (e.g. a tabletop that is comprised of two or more interconnected pieces where each piece is connected to at least one other piece by a fastening mechanism such as adhesive, welding, fasteners, or other type of fastening apparatus). In yet other embodiments, the tabletop may be another type of work surface, such as the seat of a bench that is configured to be sat on when it is in the first position. As another example, the first and second spring members 65 and 67 may each be a coil spring or another type of spring element such as an elongated elastomeric member having a channel therein sized to receive a portion of the detent member to which that spring is to engage. The third spring 43*a* may be a coil spring or may alternatively be another type of spring such as, for example, an elastomeric strap or other type of elastomeric member. As yet another example, the first, second and third elongated members 47, 49, and 41 may be rods, straps, bars, rails, or other types of elongated members composed of metal, a composite material, a polymeric material, an elastomeric material, or other type of material. As yet another example, the first and second rotatable members 51 and 53 may be triangularly shaped, circularly shaped, generally polygonally shaped, or elliptically shaped and may be composed of metal, a polymeric material, or a composite material. As yet another example, the first and second detent members 63 and 61 may each be composed of metal, a polymeric material, or a composite material and may each be structured as rod-like structures, bar-like structures, or other type of elongated member. As yet another example, the housings of the actuation mechanism, articulation mechanism 27, and detent mechanisms 25 may have any of a number of shapes and sizes and be composed of metal, a composite material, or a polymeric material. As yet another example, guide member 23*c* may be composed of metal, a composite material or a polymeric material and may have any type of suitable shape or size such as a polygonal shape, a circular shape, an oblong shape, or other type of shape. As yet another example, each element of the article of furniture and latch mechanism can be composed of any type of material that can help meet a particular design objective such as a metal, an elastomeric material, a polymeric material, or be composed of a combination of such materials due to the interconnection of different structures formed of different types of materials to form that element. In some embodiments, the housing of the actuation mechanism 23 can be configured as a handle or actuator member. In some embodiments, the housings of the actuation mechanism 23, detent mechanisms 25 and articulation mechanism 27 may be configured to fully enclose all the elements of these mechanisms or may be configured to only partially enclose a portion of the mechanisms or only enclose a number of elements of the mechanisms. Therefore, it should be understood that while certain exemplary embodiments of articles of furniture and latch mechanisms for articles of furniture and methods of making and using the same have been discussed and illustrated herein, it is to be distinctly understood that the invention is not limited thereto but may be otherwise variously embodied and practiced within the scope of the following claims.

What is claimed is:

1. A latch mechanism for an article of furniture comprising:

an actuation mechanism having a housing attached to a guide member, the housing being moveable relative to the guide member from a first position to a second position;

at least one detent mechanism comprising a first detent mechanism having a first detent member that is moveable from a first position to a second position;

an articulation mechanism positioned between the actuation mechanism and the first detent mechanism, the articulation mechanism connecting the first detent mechanism to the housing such that motion of the housing from the first position of the housing to the second position of the housing causes the first detent member to move from the first position of the first detent member to the second position of the first detent member;

wherein the at least one detent mechanism also comprises a second detent mechanism having a second detent member that is moveable from a first position to a second position, the second detent member being connected to the housing via the articulation mechanism such that motion of the housing from the first position of the housing to the second position of the housing causes the second detent member to move from the first position of the second detent member to the second position of the second detent member at the same time the first detent member moves from the first position of the first detent member to the second position of the first detent member;

a first elongated member extending from the articulation mechanism to the first detent member to connect the first elongated member to the articulation mechanism;

a second elongated member extending from the articulation mechanism to the second detent member to connect the second elongated member to the articulation mechanism;

a third elongated member extending from the housing of the actuation mechanism to the articulation mechanism to connect the articulation mechanism to the housing;

wherein the articulation mechanism comprises:

a first rotatable member and a second rotatable member positioned in a housing of the articulation mechanism, the first and second rotatable members being attached to the third elongated member such that movement of the housing of the actuation mechanism from the first position to the second position of the housing of the actuation mechanism causes the third elongated member to move such that the first and second rotatable members rotate; and a connector having a shaft, the shaft of the connector passing through the first rotatable member, the second rotatable member, and an end portion of the third elongated member to connect the third elongated member to the first and second rotatable members.

2. The latch mechanism of claim 1, wherein the guide member is configured to be affixed to a structure of an article of furniture, the guide member connectable to the housing of the actuation mechanism such that the housing is moveable relative to the guide member from the first position of the housing of the actuation mechanism to the second position of the housing of the actuation mechanism via a linear path of motion that is at least partially defined by the guide member.

3. The latch mechanism of claim 2, wherein the guide member has grooves that slideably receive rails of the housing of the actuation mechanism.

4. The latch mechanism of claim 2, wherein the structure of the article of furniture to which the guide member is affixable is a tabletop and the actuation mechanism comprises a biasing mechanism attached between the housing of the actuation mechanism and the guide member to bias the housing of the actuation mechanism to the first position of the housing of the actuation mechanism.

5. The latch mechanism of claim 4, wherein the biasing mechanism is comprised of a spring.

6. The latch mechanism of claim 4, wherein the first detent mechanism comprises a first spring member engaging the first detent member to bias the first detent member to the first position of the first detent member; and wherein the second detent mechanism comprises a second spring member engaging the second detent member to bias the second detent member to the second position of the second detent member.

7. The latch mechanism of claim 6, wherein the first detent member has a protuberance adjacent an intermediate portion of the first detent member that contacts a first end of the first spring member; and wherein the second detent member has a protuberance adjacent an intermediate portion of the second detent member that contacts a first end of the second spring member.

8. The latch mechanism of claim 6, wherein the housing of the articulation mechanism has an opening in which the first and second rotatable members are positioned and has a first channel, a second channel, and a third channel in communication with that opening, a portion of the first elongated member passing through the first channel such that the first elongated member is connectable to the first rotatable member, a portion of the second elongated member passing through the second channel such that the second elongated member is connectable to the second rotatable member, and a portion of the third elongated member passing through the third channel.

9. The latch mechanism of claim 6, wherein the guide member is positioned within the housing of the actuation mechanism.

10. The latch mechanism of claim 2, wherein the first detent mechanism comprises a first spring member engaging the first detent member to bias the first detent member to the first position of the first detent member; and wherein the second detent mechanism comprises a second spring member engaging the second detent member to bias the second detent member to the second position of the second detent member;

wherein the first detent member has a protuberance adjacent an intermediate portion of the first detent member that contacts a first end of the first spring member; and wherein the second detent member has a protuberance adjacent an intermediate portion of the second detent member that contacts a first end of the second spring member.

11. The latch mechanism of claim 1 wherein a path of travel of the housing along which the housing moves when the housing moves between the first and second positions of the housing extends in a direction that is transverse or perpendicular to a direction at which a path of travel of the first detent member extends, the path of travel of the first detent member being the path of travel along which the first detent member moves when the first detent member moves between the first and second positions of the first detent member.

12. An article of furniture having a latch mechanism of claim 1.

13. A method of using the article of furniture of claim 12, the method comprising:

providing a force to move the housing of the actuation mechanism from the first position of the housing of the actuation mechanism to the second position of the housing of the actuation mechanism;

removing the force so that the housing returns from the second position back to the first position of the housing of the actuation mechanism.

14. The method of claim 13, comprising:

biasing the housing to cause the housing to return from the second position back to the first position.

15. The method of claim 14, wherein the biasing is provided by one or more springs.

16. The method of claim 15, wherein the article of furniture is a moveable table, the method also comprising:

tilting a tabletop of the table while the force is provided to move the housing of the actuation mechanism from the first position of the housing of the actuation mechanism to the second position of the housing of the actuation mechanism; and positioning the table next to other tables to nest the tables such that tabletops of the tables are tilted for nesting of the tables.

* * * * *